US007434494B1

(12) United States Patent
Snider

(10) Patent No.: US 7,434,494 B1
(45) Date of Patent: Oct. 14, 2008

(54) SOCKET DRIVING TOOL

(76) Inventor: Richard H. Snider, 801 Sandberg La., Ventura, CA (US) 93003

( * ) Notice: Subject to any disclaimer, the term of this patent is extended or adjusted under 35 U.S.C. 154(b) by 0 days.

(21) Appl. No.: 11/511,062

(22) Filed: Aug. 28, 2006

(51) Int. Cl.
*B25B 23/16* (2006.01)
*B25B 13/02* (2006.01)
*B25G 1/08* (2006.01)

(52) U.S. Cl. ..... 81/177.1; 81/125; 81/124.4; 81/177.4

(58) Field of Classification Search ..... 81/124.4, 81/177.4, 177.1, 177.2, 125, 125.1, 490, 81/437–440
See application file for complete search history.

(56) References Cited

U.S. PATENT DOCUMENTS 1,289,558 A * 12/1918 Sedgley ..... 81/124.5
1,371,350 A * 3/1921 Campbell ..... 81/177.4
1,416,461 A * 5/1922 Hance ..... 81/177.4
1,469,589 A 10/1923 Palmer
1,478,736 A 12/1923 Gadberry
1,662,424 A * 3/1928 Judge ..... 81/177.75
2,776,589 A * 1/1957 Gregory ..... 81/177.4
4,798,111 A * 1/1989 Cheeseman ..... 81/124.4
4,982,627 A * 1/1991 Johnson ..... 81/DIG. 5
5,048,379 A 9/1991 Gramera et al.
5,309,799 A * 5/1994 Jore ..... 81/451
6,330,844 B1 12/2001 Walker
6,354,175 B1 3/2002 Dobson et al.
6,374,711 B2 * 4/2002 Anderson et al. ..... 81/177.4
7,124,665 B1 * 10/2006 Chen ..... 81/439

* cited by examiner

*Primary Examiner*—Hadi Shakeri
(74) *Attorney, Agent, or Firm*—Albert O. Cota

(57) ABSTRACT

A socket driving tool (10) that is designed to be inserted to a chuck (92) attached to an electric motor (94) or to a handle (96). The tool (10) is comprised of four major elements: a drive shaft (12), a magnet (18) attached to the front end (14) of the drive shaft (12), and a pair of sockets (50) consisting of a first socket (52) and a second socket (54). Preferably, the first socket (52) has a first fastener cavity (62) having a 5/16-inch (7.937 mm) opening, and a second fastener cavity (72) having a ¼-inch (6.350 mm) opening. The second socket (54) has a first fastener cavity (62) having a ⅜-inch (9.525 mm) opening, and a second fastener cavity (72) having a 7/16-inch (11.113 mm) opening. The socket pair (50) is designed to be arranged on the drive shaft (12) in four different configurations that provide four fastener gripping diameters. The four gripping diameters allow four different diameter fasteners (90) to be tightened or loosened by the socket driving tool (10).

2 Claims, 4 Drawing Sheets

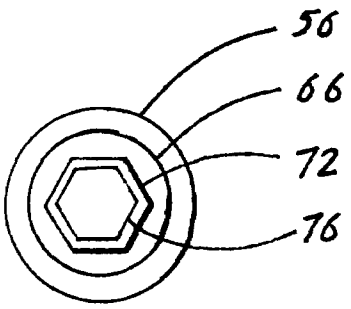
Fig. 8
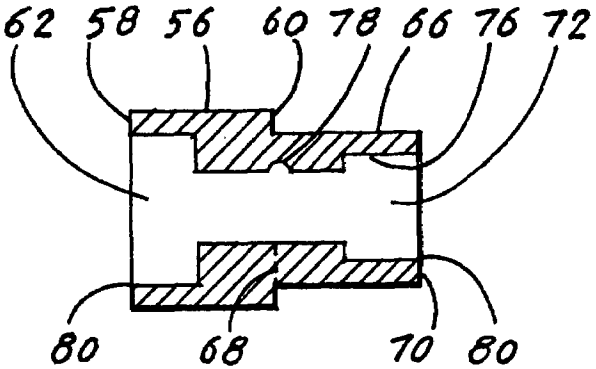
Fig. 6
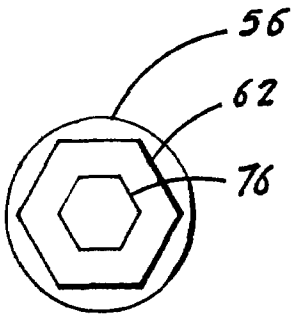
Fig. 7
PRIOR ART
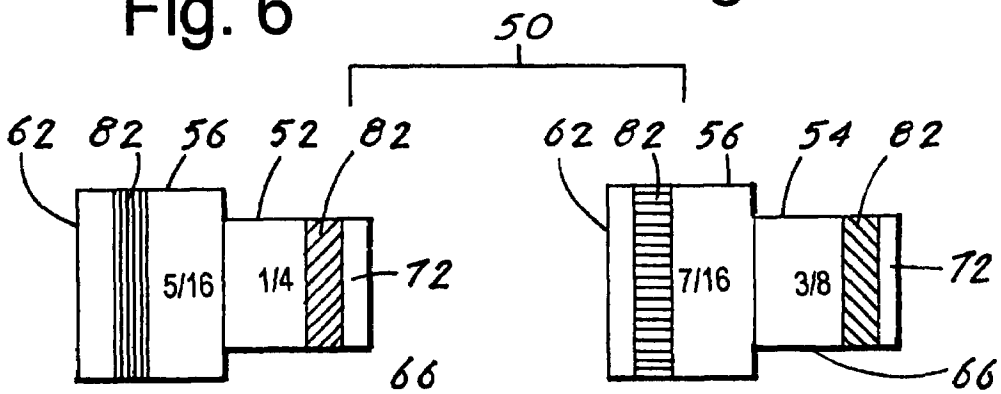
Fig. 11
Fig. 10
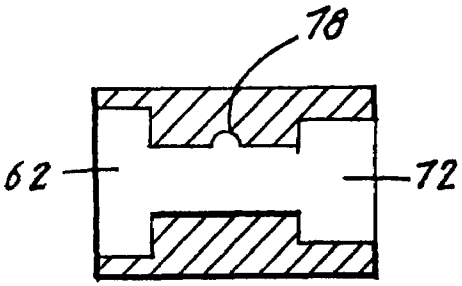
Fig. 9

SOCKET DRIVING TOOL

TECHNICAL FIELD

The invention pertains to the general field of socket driving tools, and more particularly to a socket driving tool having a drive shaft that has attached a pair of sockets that can be arranged to provide four different fastener cavities.

BACKGROUND ART

In numerous trades, it is often necessary to install and remove fasteners such as hex head fasteners in rapid succession. Adding difficulty is the fact that the fasteners must often be inserted and removed while a person is in an awkward position, such as when the person is on a roof or ladder. Various tools exist in the prior art for driving hex head fasteners. However, these tools are often limiting and encumbering, are designed to accommodate a single size or type of hex fastener, do not have a magnetic tip, and are typically only hand-driven. Therefore, at present, tradesmen must purchase and carry many different tools to perform various jobs. This situation increases the risk of being injured while performing the jobs as well as increasing the time to complete each job.

The socket driving tool of the instant invention eliminates the deficiencies present in prior art tools by producing a tool that: uses two sockets that are retained on a tool drive shaft and that can be arranged to provide four different fastener cavities, includes a magnetic tip that allows a fastener to be held while inserting or removing a fastener, and allows a fastener to be inserted or removed quickly and easily with only one hand.

A search of the prior art did not disclose any literature or U.S. patents that read directly on the claims of the instant invention. However, the following U.S. patents are considered related:

| U.S. PAT. NO. | INVENTOR | ISSUED |
|---|---|---|
| 6,354,175 | Dobson, et al | 12 Mar. 2002 |
| 6,330,844 | Walker | 18 Dec. 2001 |
| 5,048,379 | Gramera, et al | 17 Sep. 1991 |

The U.S. Pat. No. 6,354,175 patent discloses a tool for driving headed fasteners that includes an opening that is defined by a wall of the tool. The wall has a plurality of flat planar surfaces that are connected at the ends of each planar surface to define the opening. Each connection surface includes a convex surface that is continuous with the planar surface, and a concave surface that is continuous with the convex surface. The convex and concave surfaces define arcs having the same radius.

The U.S. Pat. No. 6,330,844 patent discloses a self-contained multi-use tool for tightening or loosening a range of screws, nuts and bolts. The tool consists of various screw bits and an adapter that includes a holder and a nut driver set. All the tool elements fit together in a decreasing order and can be stored on the back or inside of the handle. Each socket head is dimensioned to allow threaded bolts or rods of the associated nuts to extend through.

The U.S. Pat. No. 5,048,379 patent discloses a multi-functional, double-ended socket wrench. The wrench is designed to accept an English or metric sized nut and bolt engaging means on one socket cavity and the closest English or metric sized nut engaging means in an opposite socket cavity. Both cavities are designed to engage and rotate hexagonal nuts attached on bolt studs.

For background purposes and as indicative of the art to which the invention relates, reference may be made to the following remaining patents found in the search:

| U.S. PAT. NO. | INVENTOR | ISSUED |
|---|---|---|
| 1,478,736 | Gadberry | 25 Dec. 1923 |
| 1,469,589 | Palmer | 2 Oct. 1923 |

DISCLOSURE OF THE INVENTION

The socket driving tool disclosed herein is designed to utilized in combination with a chuck that is attached to an electric drill or that is attached to a handle. In its basic design configuration, the socket driving tool is comprised of a drive shaft and a pair of sockets.

The drive shaft is further comprised of a polygon cross-section that preferably consists of a hexagon cross-section, a first end, a rear end, a magnet that is attached to the first end of the drive shaft, a socket stop, and a detent located between the first end and the socket stop. The magnet allows a fastener to be held at the front end of the drive shaft during the insertion or the removal of a fastener.

The pair of sockets are comprised of a first socket and a second socket. Each of the sockets has a hexagonal shaft bore and two different fastener cavities. The socket pair is designed to be arranged on the drive shaft in four different configurations. The four different configurations provide four fastener gripping diameters that allow four different fastener diameters to be tightened or loosened by the socket driving tool.

In view of the above disclosure, the primary object of the invention is to provide a socket driving tool that includes a drive shaft with two sockets attached thereto. The two sockets can be arranged on the drive shaft to provide four different fastener gripping diameters.

In addition to the primary object of the invention it is also an object of the invention to provide a socket driving tool that:

- is easily used,
- conserves time,
- requires little space for storage,
- can be color coded to easily identify the diameter of each socket,
- can be produced to include various fastener gripping diameters,
- is cost effective from both a manufacturer's and consumer's point of view.

These and other objects and advantages of the present invention will become apparent from the subsequent detailed description of the preferred embodiment and the appended claims taken in conjunction with the accompanying drawings.

BRIEF DESCRIPTION OF THE DRAWINGS

FIG. 6 is a cross-sectional side view of a preferred socket design having a first diameter on a first end and a stepped-down second diameter on a second end.

FIG. 7 (prior art) is a front elevational view of the socket shown in FIG. 6.

FIG. 8 is a rear elevational view of the socket shown in FIG. 6.

FIG. 9 is a cross-sectional side view of a socket that does not have a stepped-down diameter as shown in FIG. 6.

FIGS. 10 and 11 illustrate a socket pair where each fastener cavity differs to allow the combination of the two sockets to provide four different fastener cavities.

BEST MODE FOR CARRYING OUT THE INVENTION

The best mode for carrying out the invention is presented in terms of a preferred embodiment for a socket driving tool which utilizes a drive shaft that is inserted into a pair of sockets or the socket pair can be inserted into the drive shaft as herein described.

The sockets can be arranged on the drive shaft to allow four fasteners having different diameters to be tightened or loosened. The preferred embodiment of the socket driving tool 10, as shown in FIGS. 1-18, is comprised of a drive shaft 12 and a socket pair 50.

Figure 1:
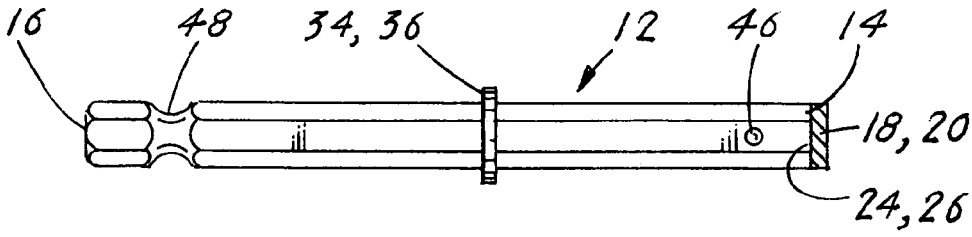
FIG. 1 is a side elevational view of a drive shaft showing the relative location of a magnet, a detent, a socket stop, and a rear end that includes a circular notch.
Figure 2:
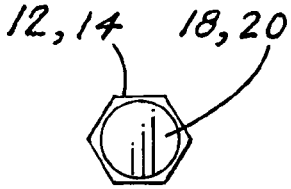
FIG. 2 is a front elevational view of the drive shaft having a front end that has attached a disc magnet.
Figure 3:
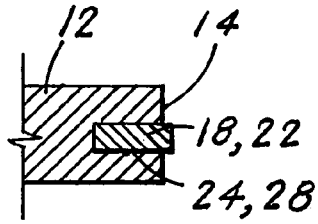
FIG. 3 is partial cross-sectional side view of the drive shaft that has a front end having a central cavity into which is inserted a circular rod magnet.
Figure 4:
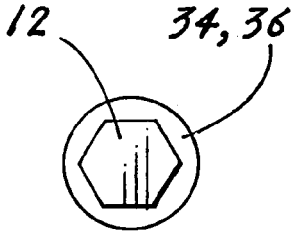
FIG. 4 is a front elevational view of the drive shaft having an integrally attached socket stop that consists of a circular segment.
Figure 5:
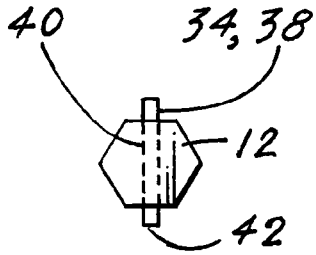
FIG. 5 is a front elevational view of the drive shaft having a pin bore into which is inserted a socket stop consisting of a protruding pin.
Figure 12:
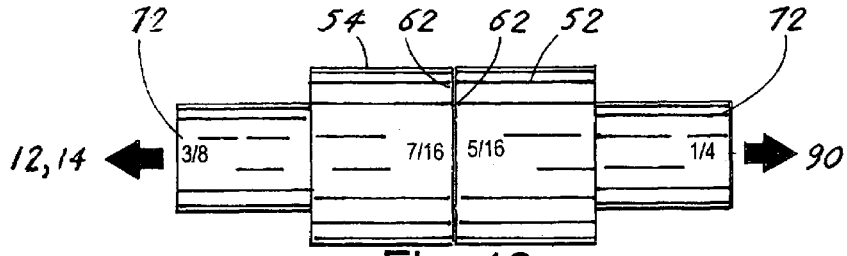
FIG. 12 is a side elevational view of a pair of sockets that are arranged to provide a ¼-inch fastener cavity.
Figure 13:
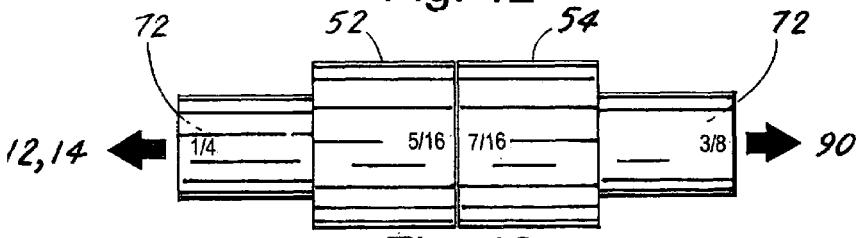
FIG. 13 is a side elevational view of a pair of sockets that are arranged to provide a ⅜-inch fastener cavity.
Figure 14:
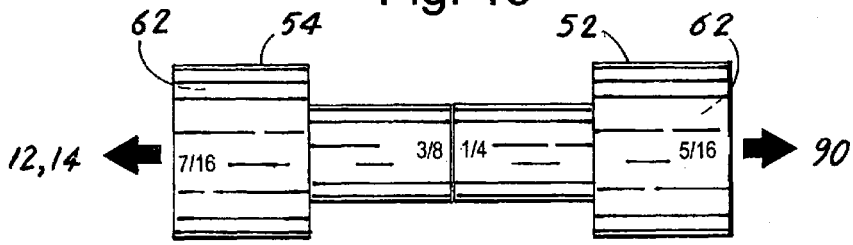
FIG. 14 is a side elevational view of a pair of sockets that are arranged to provide a 5/16-inch fastener cavity.
Figure 15:
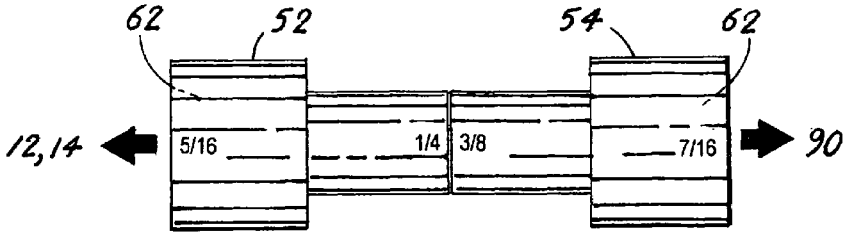
FIG. 15 is a side elevational view of a pair of sockets that are arranged to provide a 7/16-inch fastener cavity.

The drive shaft 12, as shown in FIGS. 1-5, has a polygonal cross-section that preferably consists of a hexagon cross-section, as shown best in FIGS. 4 and 5. The drive shaft 12, as shown in FIG. 1, includes a front end 14 and a rear end 16. Attached to the front end 14 is a magnet 18 that can consist of a disc magnet 20, as shown in FIGS. 1 and 2, or a circular rod magnet 22, as shown in FIG. 3. The magnet 18 is preferably comprised of an Alnico magnet which have a high magnetic strength and exhibit high corrosion resistance.

The disc magnet 20, as shown in FIGS. 1 and 2, is attached to the front end 14 of the drive shaft 12 by an attachment means 24 that preferably consists of an adhesive 26. To attach the circular rod magnet 22, the attachment means 24 is provided by forming a central cavity 28 that extends inward from the front end 14 of the drive shaft 12, as shown in FIG. 3. The circular rod magnet 22 is then frictionally inserted into the cavity 28. When the rod magnet 22 is inserted, the magnet's outward end can be flush with the front end 14 of the drive shaft 12 or preferably protrudes from the front end 14 of the drive shaft 12. The protrusion ranges from 1/64-inch (0.397 mm) to 1/16-inch (1.587 mm). The magnet 18 allows a fastener 90 to be magnetically attached to the front end 14 of the drive shaft 12 during insertion of the fastener 90 or when the fastener 90 has been removed. Thus, the inadvertent dropping of a fastener 90 is significantly reduced.

The drive shaft 12, as shown in FIGS. 1, 4 and 5, also includes a socket stop 34. The socket stop 34, as shown in FIG. 1, is located inward from the front end 14 of the drive shaft at a distance that is two times the length of a socket minus the grasping thickness of a socket which is typically ⅛-inch (3.18 mm). The socket stop distance allows a fastener 90 such as a bolt head, a screw head or a nut to be easily grasped by a socket. As shown in FIGS. 1 and 4, the socket stop 34 can be comprised of a circular segment 36 or a pin 38. The circular segment 36 is preferably formed integral to the shaft 12 and is dimensioned to extend above the surface of the drive shaft 12, as shown in FIG. 5. The pin 38, as shown in FIG. 5, is dimensioned to be inserted into a pin bore 40 that is located normal to the surface of the drive shaft, as shown in FIG. 5. When the pin 38 is inserted, the two edges 42 of the pin 38 extend above the surface of the drive shaft.

As shown in FIG. 1, the drive shaft 12 is also designed to incorporate a spring-loaded detent 46 and a circular notch 48. The spring-loaded detent 46 is located between the front end 14 of the drive shaft 12 and the socket stop 34, and functions to retain an inserted socket. The circular notch 48 is located adjacent the rear end 16 of the drive shaft 12. The notch 48 allows the drive shaft 12 to be inserted and attached to a quick-disconnect/quick-connect chuck (not shown).

The socket pair 50 are comprised of a first socket 52 and a second socket 54. A typical preferred socket design, which applies to both the first and second sockets 52, 54, is shown in the cross-sectional side view in FIG. 6, a front elevational view in FIG. 7 (prior art), and in a rear elevational view in FIG. 8. As shown in FIG. 6, the preferred socket design has a first diameter 56 on a first end 58, and a stepped-down second diameter 66 on a second end 60. In FIG. 9 is shown a cross-sectional side view of an alternate socket design that does not have a stepped-down diameter.

The typical preferred socket, as shown in FIG. 6, further includes a first end 58 and a second end 60, with the first end 58 having a first fastener cavity 62. The second diameter 66 also has a first end 68 and a second end 70, with the second end 70 having a second fastener cavity 72. As also shown in FIG. 6, the first end 68 is integrally formed with the second end 60 of the first diameter 56. Extending through the center of the socket is a drive shaft bore 76 having a hexagon cross-section that corresponds to the hexagon cross-section of the drive shaft 12.

The typical preferred socket also includes a detent 78 located on the drive shaft bore 76. The detent 78 is dimensioned and aligned with the detent 46 located on the drive shaft 12. Also, to facilitate the insertion of a fastener 90 into a socket, the inner edge of the first end 58 and the inner edge of the second end 70 have a radiused edge 80.

Additionally, the first fastener cavity 62 and the second fastener cavity 72 are color coded 82 to indicate to a user the gripping diameter of the first and second fastener cavities 62, 72.

Figure 17:
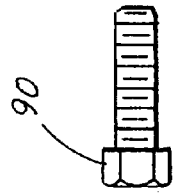
FIG. 17 is a side elevational view of a typical fastener consisting of a hexagon bolt.

The basic inventive concept of the socket driving tool 10 is that by having a socket pair 50 consisting of a first socket 52 and a second socket 54, four fasteners 90 having different diameters can be tightened or loosened. A typical fastener 90 consisting of a hexagon bolt, is shown in FIG. 17.

To use the socket driving tool 10, two sockets 52, 54 are inserted into the drive shaft 12. Several socket dimensions with various fastener cavities can be utilized that read within the scope of the claims. However, for purpose of example and explanation, a first socket 52, as shown in FIG. 10, and a second socket 54, as shown in FIG. 11, will be used. The first socket 52 has a first fastener cavity 62 that accepts a 5/16-inch (7.937 mm) fastener, and a second fastener cavity 72 that accepts a 1/4-inch (6.350 mm) fastener. The second socket 54 has a first fastener cavity 62 that accepts a 7/16-inch (11.113 mm) fastener, and a second fastener cavity 72 that accepts a 3/8-inch (9.525 mm) fastener.

The four fastener gripping diameters, as shown in FIGS. 12-15, are configured as follows.

a) To provide a 1/4-inch (6.350 mm) fastener gripping diameter:
   (1) Insert the 3/8-inch (9.525 mm) second fastener cavity 72 of the second socket 54 into the drive shaft 12 until the second fastener cavity 72 abuts with the socket stop 34,
   (2) Insert the 5/16-inch (7.937 mm) first fastener cavity 62 of the first socket 52 until the first fastener cavity 62 of the first socket 52 abuts with the first fastener cavity 62 of the second socket 54. When so configured, the 1/4-inch (6.350 mm) second fastener cavity protrudes outward from the front end 14 of the drive shaft 12.

b) To provide a 3/8-inch (9.525 mm) fastener gripping diameter:
   (1) Insert the 1/4-inch (6.350 mm) second fastener cavity 72 of the first socket 52 into the drive shaft 12 until the second fastener cavity 72 abuts with the socket stop 34.
   (2) Insert the 7/16-inch (11.113 mm) first fastener cavity 62 of the second socket 54 until the first fastener cavity 62 of the second socket 54 abuts with the first fastener cavity 62 of the first socket 52. When so configured, the 3/8-inch (9.525 mm) second fastener cavity 72 protrudes outward from the front end 14 of the drive shaft 12.

c) To provide a 5/16-inch (7.397 mm) fastener gripping diameter:
   (1) Insert the 7/16-inch (11.113 mm) first fastener cavity 62 of the second socket 54 into the drive shaft 12 until the first fastener cavity 62 abuts with the socket stop 34.
   (2) Insert the 1/4-inch (6.350) second fastener cavity 72 of the first socket 52 until the second fastener cavity 72 of the first socket 52 abuts with the second fastener cavity 72 of the second socket 54. When so configured, the 5/16-inch (7.937 mm) first fastener cavity 62 protrudes outward from the front end 14 of the drive shaft 12.

d) To provide a 7/16-inch (11.113 mm) fastener gripping diameter:
   (1) Insert the 5/16-inch (7.937 mm) first fastener cavity 62 of the first socket 52 into the drive shaft 12 until the first fastener cavity 62 abuts with the socket stop 34.
   (2) Insert the 3/8-inch (9.525 mm) second fastener cavity 72 of the second socket 54 until the second fastener cavity 72 of the second socket 54 abuts with the second fastener cavity 72 of the first socket 52. When so configured, the 7/16-inch (11.113 mm) first fastener cavity 62 protrudes from the front end 14 of the drive shaft.

Figure 16:
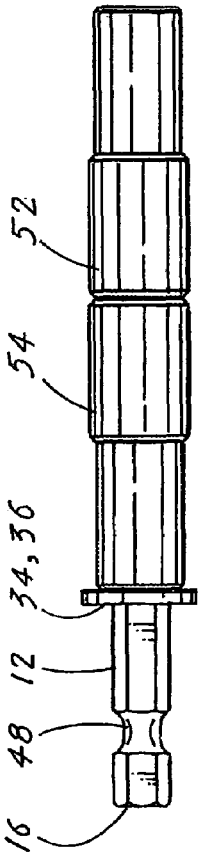
FIG. 16 is a side elevational view of a fully assembled socket driving tool.
Figure 18:
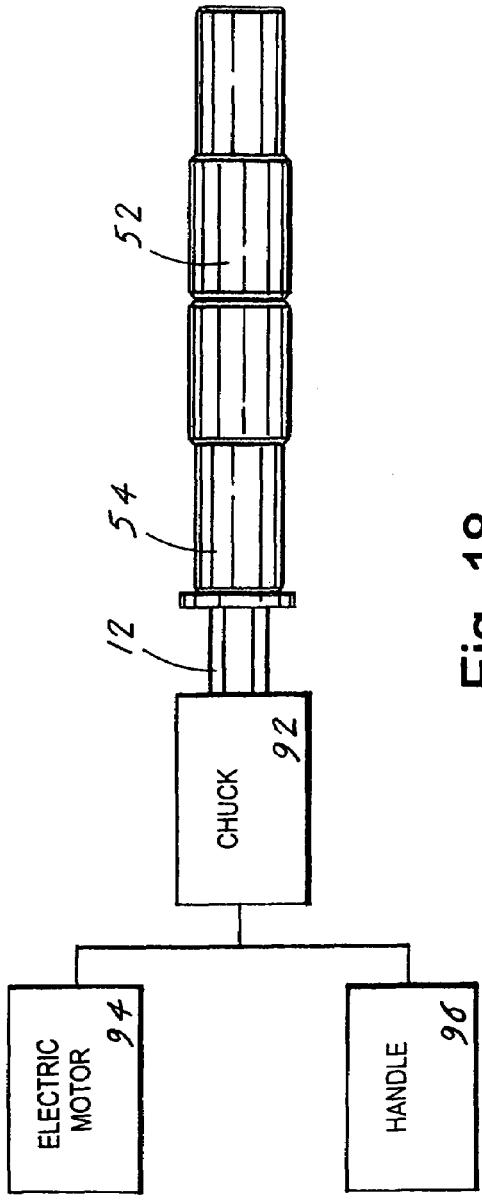
FIG. 18 is a side elevational view of a socket driving tool that is inserted into a chuck which can be rotated by either an electric motor or by a handle.

The socket driving tool 10, which is shown fully assembled in FIG. 16, is designed to be inserted into a chuck 92. The chuck 92 can be an integral element of an electric motor 94, as shown in FIG. 18, or the chuck 92 can be an integral element of a manually operated handle 96, as also shown in FIG. 18.

While the invention has been described in detail and pictorially shown in the accompanying drawings it is not to be limited to such details, since many changes and modifications may be made to the invention without departing from the spirit and the scope thereof. Hence, it is described to cover any and all modifications and forms which may come within the language and scope of the claims.

The invention claimed is:

1. A socket driving tool that is designed to be attached to a chuck which is driven by an electric motor or that is attached to a chuck operated by a handle, said tool comprising:

a) a drive shaft having:
   (1) a hexagon cross-section,
   (2) a front end,
   (3) a rear end having adjacent thereto a circular notch that allows said drive shaft to be inserted and attached to a quick-disconnect/quick connect chuck,
   (4) a magnet that is attached to the front end of said drive shaft by an attachment means,
   (5) a socket stop located inward from the front end at a distance that is two times the length of a socket minus the grasping thickness of a fastener that is to be inserted into said tool, wherein said socket stop is comprised of a circular segment that extends above the surface of said drive shaft and that is formed integral to said drive shaft,
   (6) a detent located between the front end and the socket stop, b) a pair of sockets comprising:
   (1) a first socket having:
      (a) a first diameter having a first end and a second end, with the first end further having a first fastener cavity,
      (b) a second diameter having a first end and a second end, with the second end having a second fastener cavity, wherein the first end is integral with the second end of the first diameter,
      (c) a drive shaft bore that extends through the center of said inner socket and that has a polygonal cross-section that is dimensioned to allow said inner socket to be frictionally inserted into said drive shaft,
      (d) a detent that is located on the drive shaft bore in alignment with the detent located on said drive shaft, c) a second socket having:
   (a) a first diameter having a first end and a second end, with the first end further having a first fastener cavity,
   (b) a second diameter having a first end and a second end, with the second end further having a second fastener cavity, wherein the first end is integral with the second end of the first diameter,
   c) a drive shaft bore that extends through the center of said outer socket and that has a polygonal cross-section that is dimensioned to allow said outer socket to be frictionally inserted into said drive shaft,
   d) a detent that is located on the drive shaft bore in alignment with the detent located on said drive shaft, and
   e) wherein to utilize said socket driving tool, the first or second said socket is initially inserted into the first end of said drive shaft until the first or second said socket abuts the socket stop, the remaining said socket is then inserted into the first end of said drive shaft to allow the remaining said socket to abut with the previously inserted said socket, wherein when the two sockets are inserted, the last inserted socket extends outward beyond the first end of said drive shaft, thus allowing a fastener to be inserted into said socket's fastener cavity and be driven by said socket driving tool.

2. A socket driving tool that is designed to be attached to a chuck which is driven by an electric motor or that is attached to a chuck operated by a handle, said tool comprising:

a) a drive shaft having:

(1) a polygonal cross-section, (2) a front end, (3) a rear end, (4) a magnet that is attached to the front end of said drive shaft by an attachment means, (5) a socket stop located inward from the front end at a distance that is two times the length of a socket minus the grasping thickness of a fastener that is to be inserted into said tool, wherein said socket stop is comprised of a pin that is dimensioned to be frictionally inserted into a pin bore which is located normal to the surface of said shaft, wherein when the pin is inserted, the two edges of said pin extend above the surface of said drive shaft, (6) a detent located between the front end and the socket stop, b) a pair of sockets comprising:

(1) a first socket having:

(a) a first diameter having a first end and a second end, with the first end further having a first fastener cavity, (b) a second diameter having a first end and a second end, with the second end having a second fastener cavity, wherein the first end is integral with the second end of the first diameter, (c) a drive shaft bore that extends through the center of said inner socket and that has a polygonal cross-section that is dimensioned to allow said inner socket to be frictionally inserted into said drive shaft, (d) a detent that is located on the drive shaft bore in alignment with the detent located on said drive shaft, c) a second socket having:

(a) a first diameter having a first end and a second end, with the first end further having a first fastener cavity, (b) a second diameter having a first end and a second end, with the second end further having a second fastener cavity, wherein the first end is integral with the second end of the first diameter, (c) a drive shaft bore that extends through the center of said outer socket and that has a polygonal cross-section that is dimensioned to allow said outer socket to be frictionally inserted into said drive shaft, (d) a detent that is located on the drive shaft bore in alignment with the detent located on said drive shaft, and (e) wherein to utilize said socket driving tool, the first or second said socket is initially inserted into the first end of said drive shaft until the first or second said socket abuts the socket stop, the remaining said socket is then inserted into the first end of said drive shaft to allow the remaining said socket to abut with the previously inserted said socket, wherein when the two sockets are inserted, the last inserted socket extends outward beyond the first end of said drive shaft, thus allowing a fastener to be inserted into said socket's fastener cavity and be driven by said socket driving tool.

* * * * *